US007585254B1

(12) United States Patent
Vittone et al.

(10) Patent No.: US 7,585,254 B1
(45) Date of Patent: Sep. 8, 2009

(54) RESISTANCE BAND EXERCISE MACHINE

(76) Inventors: Suzanne R. Vittone, 5553 W. Center Dr., Hurley, WI (US) 54534; Larry W. Vittone, 5553 W. Center Dr., Hurley, WI (US) 54534

( * ) Notice: Subject to any disclaimer, the term of this patent is extended or adjusted under 35 U.S.C. 154(b) by 205 days.

(21) Appl. No.: 11/354,797

(22) Filed: Feb. 15, 2006

(51) Int. Cl.
*A63B 22/00* (2006.01)

(52) U.S. Cl. ..... 482/54; 482/51; 482/70

(58) Field of Classification Search ..... 482/51–54, 482/70, 57, 121, 123, 138
See application file for complete search history.

(56) References Cited

U.S. PATENT DOCUMENTS

| | | | | |
|---|---|---|---|---|
| 4,434,981 | A | | 3/1984 | Norton |
| 5,104,119 | A | | 4/1992 | Lynch |
| 5,110,117 | A | | 5/1992 | Fisher et al. |
| 5,171,196 | A | | 12/1992 | Lynch |
| 5,203,751 | A | | 4/1993 | Chang |
| 5,378,209 | A | * | 1/1995 | Kendrew ..... 482/52 |
| 5,382,209 | A | | 1/1995 | Pasier et al. |
| 5,405,305 | A | | 4/1995 | Wilkinson et al. |
| 5,460,586 | A | | 10/1995 | Wilkinson et al. |
| D364,662 | S | * | 11/1995 | Camfield et al. ..... D21/668 |
| 5,476,431 | A | * | 12/1995 | Wilkinson et al. ..... 482/54 |
| 5,503,610 | A | * | 4/1996 | Metcalf et al. ..... 482/70 |
| 5,584,783 | A | * | 12/1996 | Hagg et al. ..... 482/57 |
| 5,595,556 | A | | 1/1997 | Dalebout et al. |
| 5,674,168 | A | * | 10/1997 | Wilkinson ..... 482/138 |
| 5,803,874 | A | | 9/1998 | Wilkinson |
| 5,860,894 | A | | 1/1999 | Dalebout et al. |
| 5,871,421 | A | | 2/1999 | Trulaske et al. |
| 6,027,429 | A | * | 2/2000 | Daniels ..... 482/5 |
| 6,042,516 | A | * | 3/2000 | Norton ..... 482/54 |
| 6,267,711 | B1 | * | 7/2001 | Hinds ..... 482/121 |
| 6,520,891 | B1 | | 2/2003 | Stephens, Jr. |
| 6,723,028 | B1 | | 4/2004 | Wang et al. |
| 6,835,167 | B2 | | 12/2004 | Schmidt |
| 2005/0032613 | A1 | | 2/2005 | Wehrell |
| 2005/0124471 | A1 | | 6/2005 | Wilkinson |
| 2006/0128539 | A1 | * | 6/2006 | Marquez ..... 482/123 |

* cited by examiner

*Primary Examiner*—Glenn Richman
(74) *Attorney, Agent, or Firm*—Luedeka, Neely & Graham PC

(57) ABSTRACT

An exercise machine, including an elastic band and a tension fulcrum positioned so that the band extends around the tension fulcrum to provide resistance exercise to the user.

9 Claims, 5 Drawing Sheets

RESISTANCE BAND EXERCISE MACHINE

FIELD OF THE INVENTION

The disclosure relates generally to exercise devices. More particularly, the disclosure relates to exercise machines of the type utilizing resistance bands.

BACKGROUND AND SUMMARY OF THE INVENTION

Treadmills and other perambulatory exercise devices such as walkers, ellipticals, and the like often incorporate handles, poles or the like which are independently movable of one another for enabling the user to achieve additional exercise of the upper body. In one aspect, it has been discovered that significant improvements may be achieved by incorporating one or more resistance bands into such exercise devices.

In this regard, one aspect of the disclosure relates to an improved exercise device of the type having independently movable handles which offers enhanced exercise attributes. In a preferred embodiment, the device includes an elongate handle member having a first portion pivotally mounted to a base and a second portion opposite the first portion and configured for grasping by a user; and a resistance system operable with the handle.

The resistance system includes an elastic band having a first end portion connected to the elongate handle member adjacent the first portion of the handle, a second end portion fixedly positionable relative to the first end portion of the elastic band, and a tension fulcrum positioned so that the band extends around the tension fulcrum. As the elongate handle member is moved in a first direction the movement thereof is resisted by the band to provide resistance exercise to the user.

In other aspects, the resistance system may be adapted to a wide variety of exercise devices to provide resistance to exercise motion. In such devices, which includes treadmill devices, the exercise device includes a user engaging member with which a user interacts with during performance of an exercise. A resistance system operably associated with the user engaging member to provide resistance exercise to the user during movement of the user engaging member by the user.

The resistance system includes an elastic band having a first end portion connected to the user engaging member, a second end portion fixedly positionable relative to the first end portion of the elastic band, and a tension fulcrum positioned so that the band extends around the tension fulcrum such that as the user engaging member is moved in a first direction the movement thereof is resisted by the band to provide resistance exercise to the user.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1:
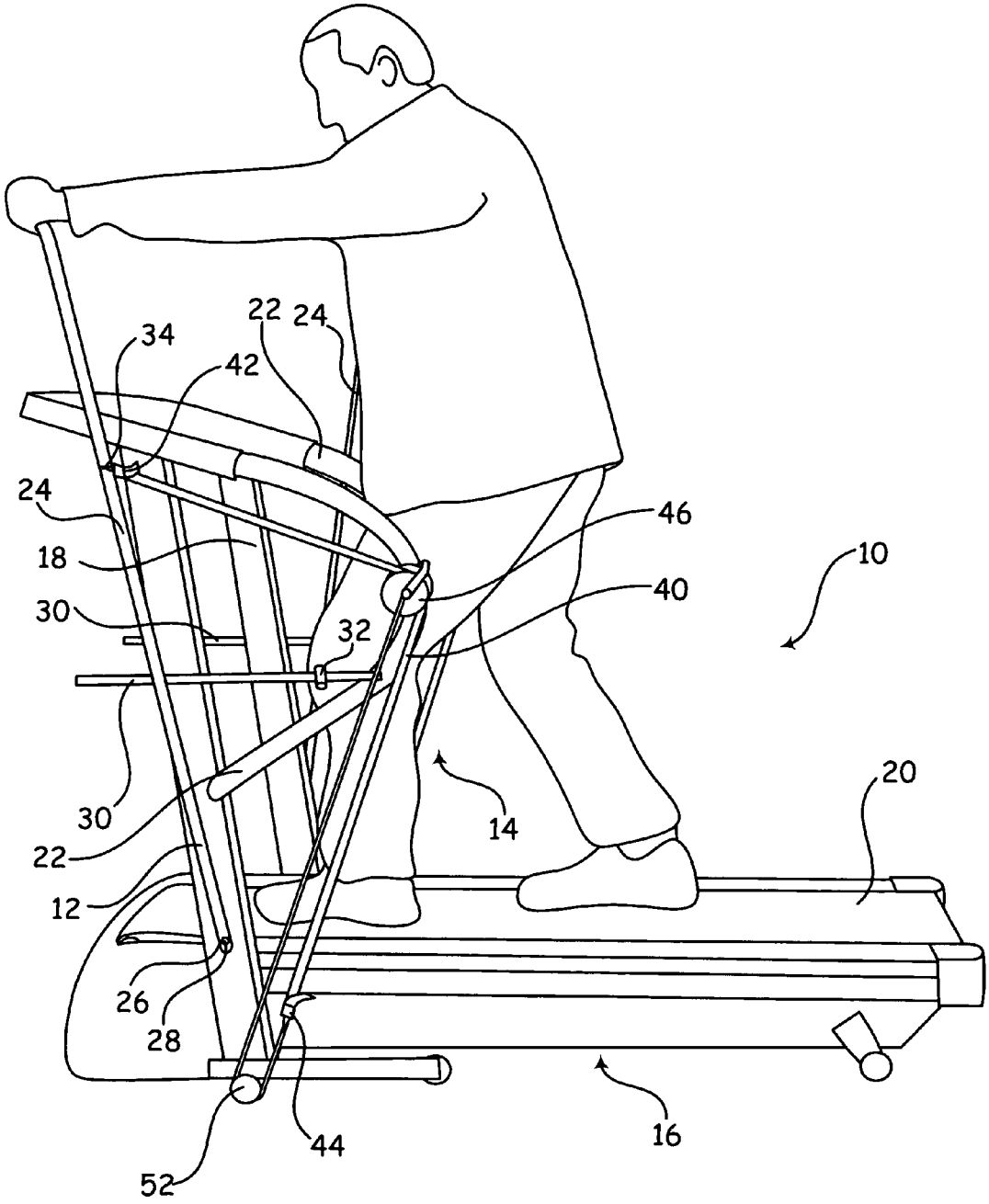
FIG. 1 is side view of an exercise device in accordance with one embodiment.
Figure 2:
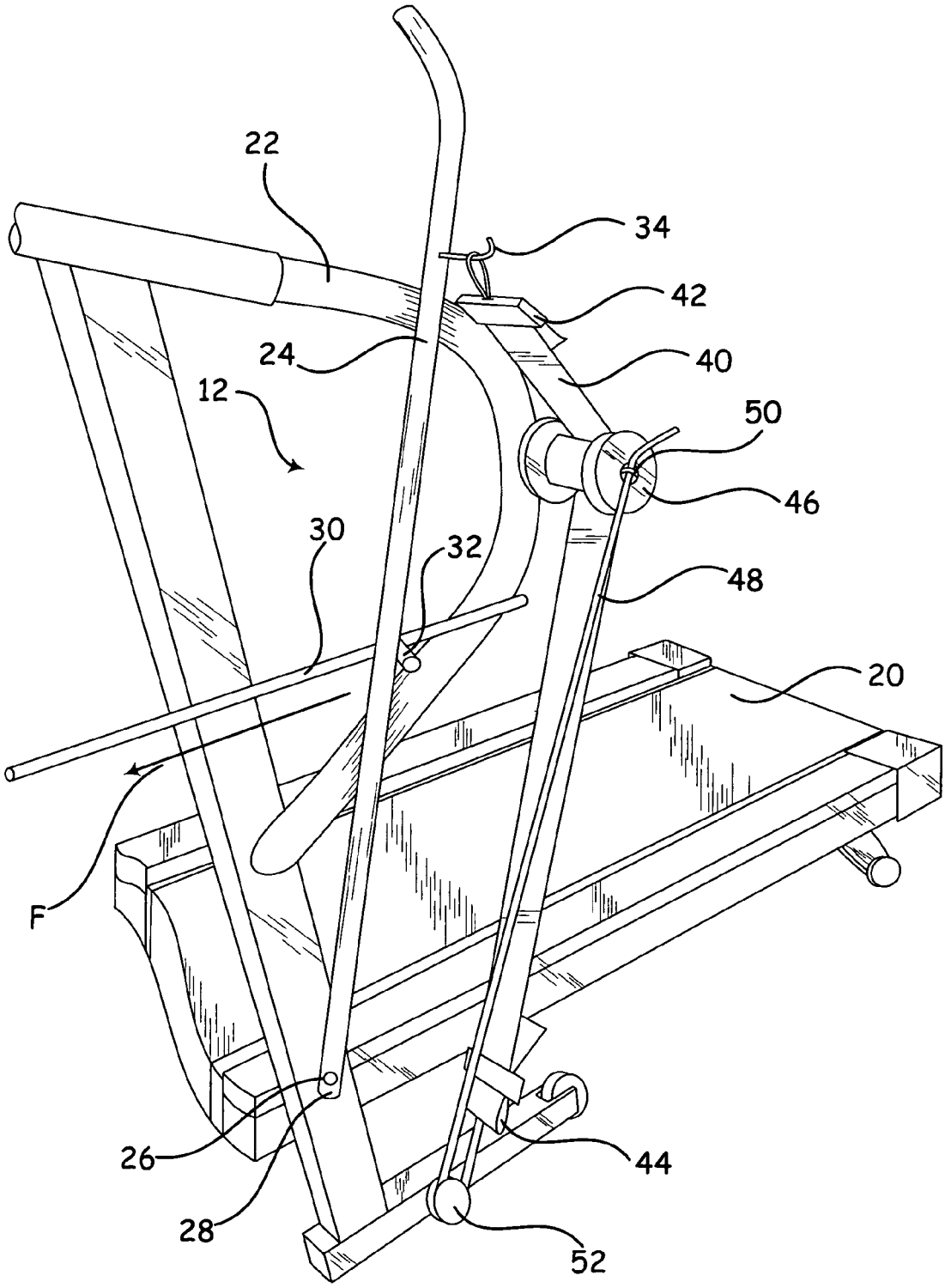
FIG. 2 is a close-up view of a handle and an associated resistance system of the device of FIG. 1.

With reference to FIGS. 1 and 2, there is shown an exercise machine 10 having one or more independently elongate handle members 12, and a resistance system 14 operatively associated with each of the members 12. The exercise machine 10 is shown as a treadmill 16 having a frame 18 supporting a movable tread 20 upon which a user is supported.

The treadmill 16 shown in FIG. 1 is a conventional treadmill of the type having an electrical motor driving the tread 20. The frame 18 of the treadmill 16 includes a pair of stationary handles 22. The treadmill 16 has been modified according to the disclosure to include the elongate handle members 12 and the resistance systems 14, as described below.

The elongate handle members 12 may be provided as by poles 24 having a lower end portion 26 pivotally connected to a base, preferably provided by a portion of the frame 18 or other substantially immobile structure, as by a fastener, such as bolt 28. To limit the travel of the poles 24, rods 30 each having a stop 32 may be provided on the frame 18. An upper portion of each of the poles 24 is configured for grasping by the user. The user may grasp the poles 24 and independently pivot the poles 24 in a forward and rearward direction, with the forward extent of travel limited by the resistance systems 14 and the rearward extent of travel limited by the stops 32. An upper portion of each of the poles 24 preferably includes a connector 34, such as a hook or other projection for connection of the resistance systems 14 thereto.

As shown in FIGS. 1 and 2, each resistance system 14 preferably includes a resistance band 40 having a first end 42 connected to the pole 24 via the connector 34 and a second end 44 positioned so that the band 40 extends around a tension fulcrum 46, preferably provided as by a carriage roller rotatably secured to the stationary handle 22. In this regard, it is preferred that the tension fulcrum 46 be provided by a roller or the like such that when force is exerted by the user to stretch the band 40, the fulcrum 46 rolls the band 40 in the direction of the force exerted by the user. As a result, the band stretches more between the handle and the tension fulcrum than between the fulcrum and the opposite end of the band. This relative stretching has been observed to provide a smooth exercise motion for the user.

The tension fulcrum 46 is desirably positioned such that as the pole 24 is moved forward from a position corresponding to the location of the stop 32, as indicated by the arrow F (FIG. 2), the movement of the pole 24 is resisted by the band 40 to provide resistance exercise to the user. The end 44 may be secured in position to maintain the desired position of the band 40 around the tension fulcrum 46, such as by securing the end 44 to a lower end of the pole 24, to the frame 18, or other fixed point.

A desired pre-set tension may independently be applied to each of the bands 40 as by selecting an appropriate length of band material. In this regard, a preferred band material is made of synthetic rubber materials such as latex or other elastomeric rubber-like materials. Alternatively, a length of cable 48 may be connected to the end 44 of the band 40 and secured to a fixed point to apply a desired pre-set tension to the band 40. For example, a cable clamp 50 or other cable securing structure may be provided on the end of the fastener used to mount the tension fulcrum 46 or other fixed point for adjustably fixing the length of the cable 48 that extends between the end 44 of the band 40 and the clamp 50 to allow adjustment of the pre-set tension of the band 40. To facilitate this, a cable fulcrum 52, such as a pulley or the like may be secured to the frame 18 or other fixed point for positioning of the cable 44. In this regard, it will be understood that the pre-set tension of the band 40 is the tension of the band 40 when the pole 24 is at rest against the stop 32.

To use the machine 10, a user may stand on the tread 20 and grasp the poles 24 while performing a perambulatory motion to resist the movement of the tread. To enhance the exercise experience, the user may urge the poles 24, independently or simultaneously, or in an alternating fashion, in the direction of the arrow F as the user performs the perambulatory motion. It has been observed that such action by the user will provide resistance exercise for many body parts, including the arms, stomach, back, and legs to provide an overall exercise experience in excess of that experienced by simply resisting the motion of the tread 20 and not utilizing the poles 24. The pre-set tensions of the bands 40 may be adjusted to provide the desired resistance.

Figure 3:
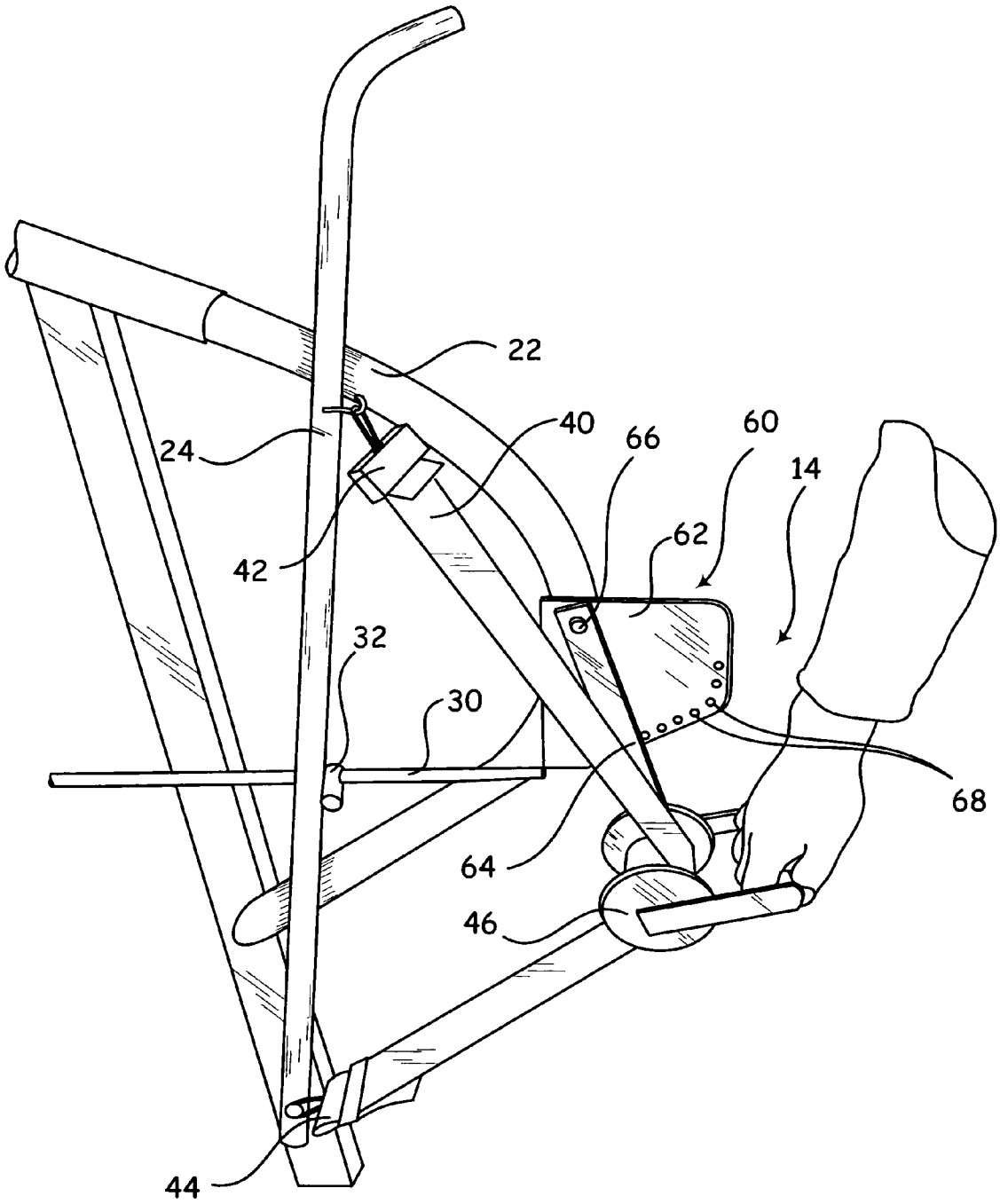
FIG. 3 shows an alternate embodiment of a resistance system.
Figure 4:
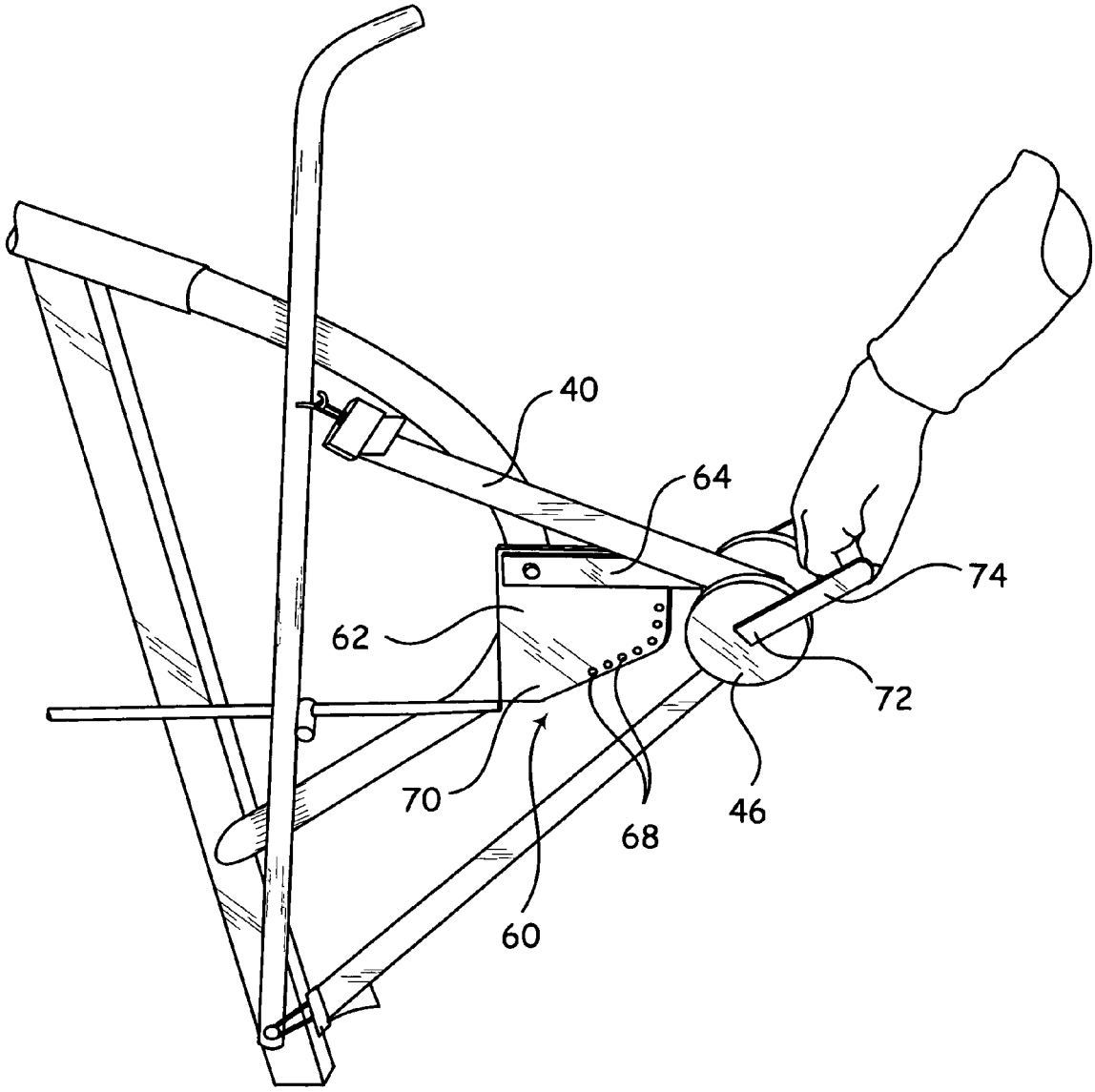
FIG. 4 is a close-up view of a portion of the resistance system of FIG. 4.

With reference now to FIGS. 3 and 4, there is shown an alternate embodiment of a resistance system 14'. The resistance system 14' is substantially similar to the resistance system 14, except the position of the tension fulcrum 46 is adjustable. Also, as seen, the end 44 of the band 40 is secured to a fixed point, such as the lower end of the pole 24, or the frame 18, such that the cable 48 is not utilized.

To enable adjustment of the position of the tension fulcrum 46, the resistance system 14' includes an adjustable fulcrum mount 60, preferably located on the handle 22 or other portion of the frame. The mount 60 includes a plate 62 secured to the handle 22 and a pivot member 64 pivotally mounted to the plate 62 as by a fastener 66 or the like. The plate 62 includes a plurality of apertures 68 for receiving a pin or other stop adjustably positionable within the apertures 68 to limit the downward travel of the pivot member 64. The pre-set tension of the band 40 is greater the higher the placement of the pin. For example, maintaining the fulcrum 46 at the position shown in FIG. 4 yields a greater pre-set position than does the fulcrum position depicted in FIG. 3.

The fulcrum 46 is preferably rotatably connected to the pivot member 46 as by a fastener #72, with a handle 74 preferably being included for enabling a user to grasp as seen in FIG. 4 to facilitate adjustment of the position of the fulcrum 46. That is, the user may grasp the handle 74 to pivot the member 64 upwardly away from the pin (against the resistance of the band 40) so that the pin may be relocated to a different one of the apertures 68, after which the handle 74 is released such that the tension of the band 40 urges the pivot member 64 against the pin.

Figure 5:
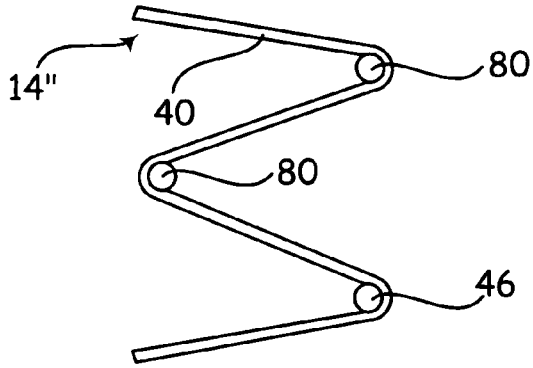
FIG. 5 shows a further embodiment of a resistance system.

With reference to FIG. 5, there is shown an alternate embodiment of a resistance system 14". The resistance system 14" is substantially similar to the resistance systems 14 and 14', except that the band 40 travels around one or more additional rollers 80 in addition to the tension fulcrum 46 to render the band in a substantially compact, such as serpentine, configuration. As will be appreciated, this configuration enables the use of a relatively long band in a compact space. Thus, this configuration of a resistance system is particularly configured for compact exercise machines.

Figure 6:
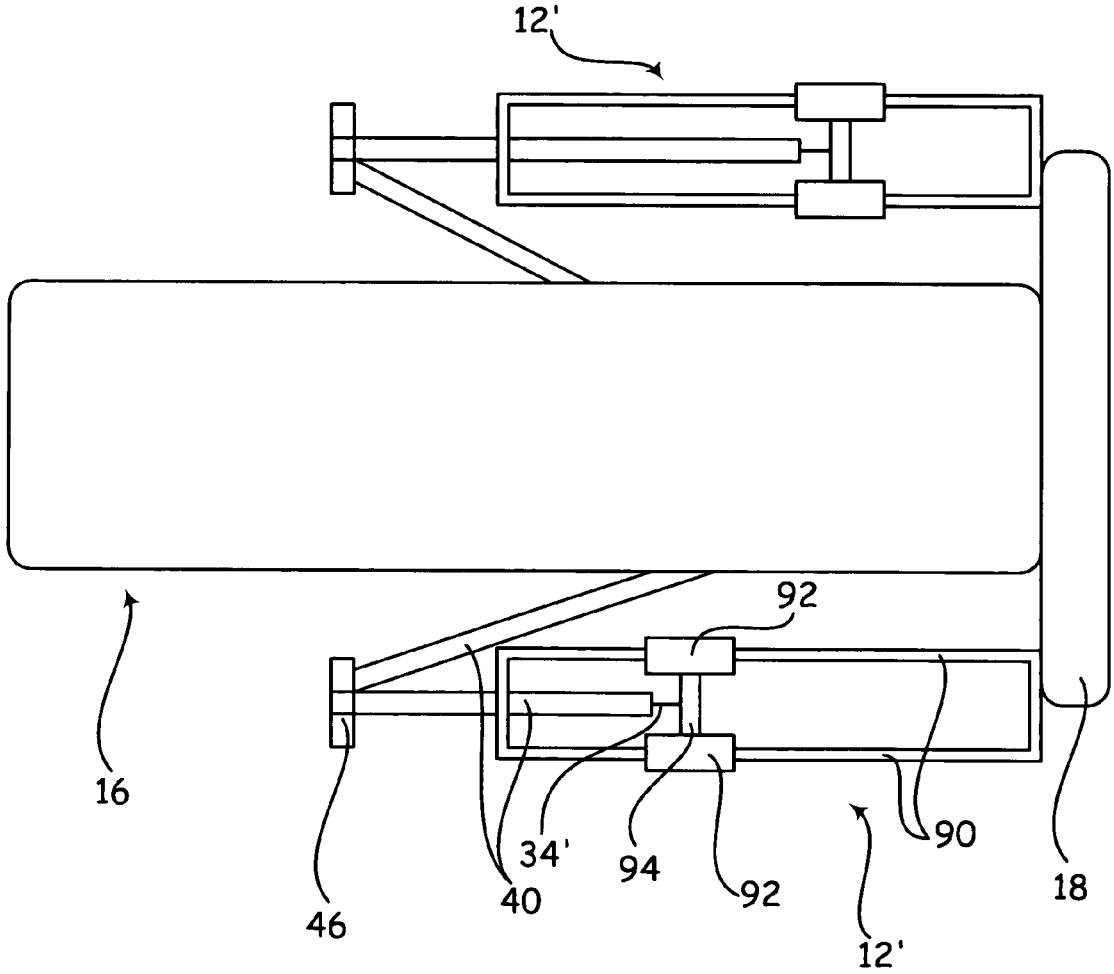
FIG. 6 is a top plan view of another embodiment of an exercise machine having sliding handle members.

With reference to FIG. 6, there is shown an alternate embodiment of an exercise machine which substantially corresponds to the exercise machine 10, but having handle system 12' instead of handles 12. The handle system 12' includes slides 90 which slidingly travel along guides 92 mounted to the frame 18. A hand grip 94 extends between the slides 90 for grasping by a user. The slides 90 may be provided as by cylinders, preferably including interior bearings, which travel along the guides 92, which may be rods, for example. The end of the band 40 of the resistance system 14, 14', or 14" may be connected to the hand grip 96 as by connector 34', which may correspond to the connector 34.

While the exercise machines are described herein as a treadmill, it will be understood, that the exercise machines may be of other configuration such as an elliptical machine or stationary bicycle, or stair climber or the like. The exercise machine 10 may also be otherwise configured, such as a weight lifting or resistance exercise device, with the resistance system incorporated to provide or enhance exercise resistance.

In the various configurations of the exercise machine, it will be understood that the exercise device includes a user engaging member with which a user interacts with during performance of an exercise. For example, the handle members 12 or other user engaging devices such as a pull handle or leg engaging member or the like with which the user interacts for exercise. A resistance system is operably associated with the user engaging member to provide resistance exercise to the user during movement of the user engaging member by the user.

The resistance system includes an elastic band having a first end portion connected to the user engaging member, a second end portion fixedly positionable relative to the first end portion of the elastic band, and a tension fulcrum positioned so that the band extends around the tension fulcrum such that as the user engaging member is moved in a first direction the movement thereof is resisted by the band to provide resistance exercise to the user.

The foregoing description of certain exemplary embodiments of the present invention has been provided for purposes of illustration only, and it is understood that numerous modifications or alterations may be made in and to the illustrated embodiments without departing from the spirit and scope of the invention.

The invention claimed is:

1. An exercise machine, comprising: an elongate handle member having a first portion pivotally mounted to a base and a second portion opposite the first portion and configured for grasping by a user; and a resistance system comprising an elastic band having a first end portion connected to the elongate handle member adjacent the second portion of the handle, a second end portion fixedly positionable relative to the first end portion of the elastic band, and a tension fulcrum positioned so that the band extends around the tension fulcrum such that as the elongate handle member is moved in a first direction the movement thereof is resisted by the band to provide resistance exercise to the user.

2. The exercise system of claim 1, wherein the exercise machine comprises a treadmill.

3. The exercise machine of claim 1, wherein the elastic band is made of an elastomeric material.

4. The exercise machine of claim 1, further comprising a stop configured to limit the extent of movement of the handle in a second direction different from the first direction.

5. The exercise machine of claim 1, further comprising a length of cable connected to an end of the elastic band and secured to a fixed point to apply a desired pre-set tension to the band.

6. The exercise machine of claim 1, wherein the tension fulcrum is adjustably positionable to adjust a pre-set tension of the elastic band.

7. The exercise machine of claim 1, wherein the tension fulcrum comprises a roller and when force is exerted by a user to stretch the band, the fulcrum rolls the band in the direction of the force exerted by the user so that the band stretches more between the first end portion of the band and the tension fulcrum than between the fulcrum and the second end portion of the band.

8. An exercise machine, comprising: a user engaging member with which a user interacts with during performance of an exercise, and a resistance system operably associated with the user engaging member to provide resistance exercise to the user during movement of the user engaging member by the user, the user engaging system comprising a slide which travels along a guide, with a hand grip connected to the slide and configured for grasping by a user, and the resistance system comprising an elastic band having a first end portion connected to the user engaging member, a second end portion fixedly positionable relative to the first end portion of the elastic band, and a tension fulcrum positioned so that the band extends around the tension fulcrum such that as the user engaging member is moved in a first direction the movement thereof is resisted by the band to provide resistance exercise to the user.

9. An exercise machine, comprising: a user engaging member with which a user interacts with during performance of an exercise, and a resistance system operably associated with the user engaging member to provide resistance exercise to the user during movement of the user engaging member by the user, the resistance system comprising an elastic band having a first end portion connected to the user engaging member, a second end portion fixedly positionable relative to the first end portion of the elastic band, and a tension fulcrum positioned so that the band extends around the tension fulcrum such that as the user engaging member is moved in a first direction the movement thereof is resisted by the band to provide resistance exercise to the user, wherein the band is positioned around one or more rollers in addition to the tension fulcrum to render the band in a substantially compact configuration.

* * * * *